US005271564A

United States Patent [19]

Smith

[11] Patent Number: 5,271,564

[45] Date of Patent: Dec. 21, 1993

[54] SPRAY GUN EXTENSION

[76] Inventor: William C. Smith, 7701 Whiterim Ter., Potomac, Md. 20854

[21] Appl. No.: 836,965

[22] Filed: Feb. 19, 1992

Related U.S. Application Data

[63] Continuation-in-part of Ser. No. 680,365, Apr. 4, 1991, abandoned.

[51] Int. Cl.[5] ..... B05B 7/02; B05B 15/08

[52] U.S. Cl. ..... 239/532; 239/525; 239/587.1; 239/290; 251/293

[58] Field of Search ..... 239/525, 532, 587.1, 239/587.5, 280, 290, 526; 251/293, 242

[56] References Cited

U.S. PATENT DOCUMENTS

| | | | |
|---|---|---|---|
| 1,957,705 | 5/1934 | Ferguson | 239/587.5 |
| 1,961,481 | 6/1934 | Downs | 91/45 |
| 2,596,191 | 5/1952 | Windhom, Jr. | 239/526 |
| 2,635,010 | 4/1953 | Sanders et al. | 137/893 |
| 3,385,524 | 5/1968 | Wahlin | 239/526 |
| 3,700,174 | 10/1972 | Beck | 239/526 |
| 3,796,376 | 3/1974 | Farnsteiner | 239/528 |
| 3,940,072 | 2/1976 | Ishikawa et al. | 239/525 |
| 4,323,196 | 4/1982 | Logue et al. | 239/532 |
| 4,850,809 | 7/1989 | Smith | 417/76 |
| 4,991,776 | 2/1991 | Smith | 239/302 |
| 5,044,557 | 9/1991 | Smith | 239/302 |
| 5,058,807 | 10/1991 | Smith | 239/302 |

FOREIGN PATENT DOCUMENTS

| | | | |
|---|---|---|---|
| 301176 | 4/1971 | U.S.S.R. | 239/532 |

*Primary Examiner*—Andres Kashnikow
*Assistant Examiner*—Christopher G. Trainor
*Attorney, Agent, or Firm*—William S. Ramsey

[57] ABSTRACT

An spray gun extension used in the application of liquids such as paints and other coatings, cleaning solutions, solvents, blasting agents, solvents, sealants, lubricants and pesticides in high volume low pressure spraying. The extension allow the application of such liquids to areas above, below, around, behind, or into devices or fixtures not visible and otherwise inaccessible to the applicator. The extension is rotatively mounted to the spray gun. A spray head is rotatively mounted on the extension. A variety of spray nozzles may be used, including a fixed nozzle, and a nozzle which may be used to vary the spray pattern width and fan shape. Liquid flow is controlled by a needle valve near the end of the extension. The extension may be used to spray straight ahead or at any angle including back toward the spray gun.

3 Claims, 6 Drawing Sheets

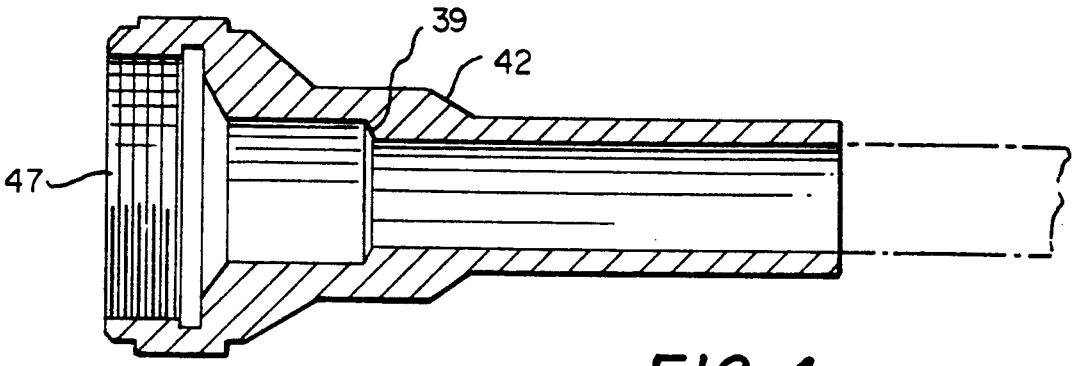
FIG. 4
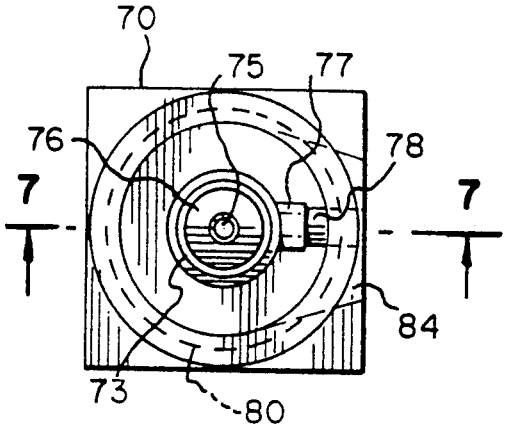
FIG. 6
FIG. 5
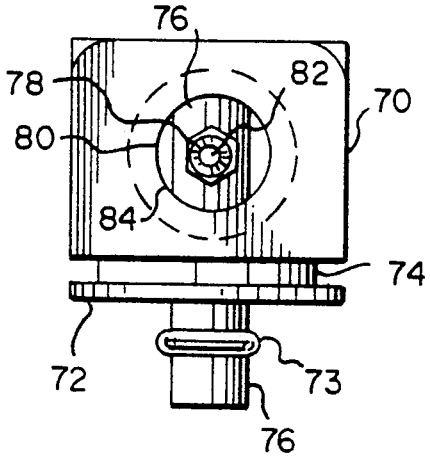
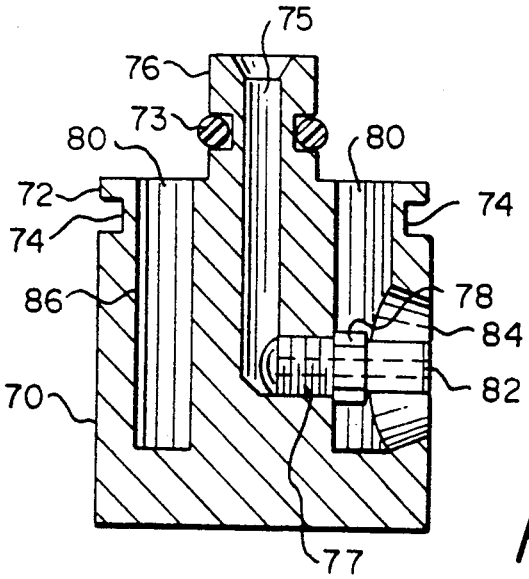
FIG. 7

FIG. 11
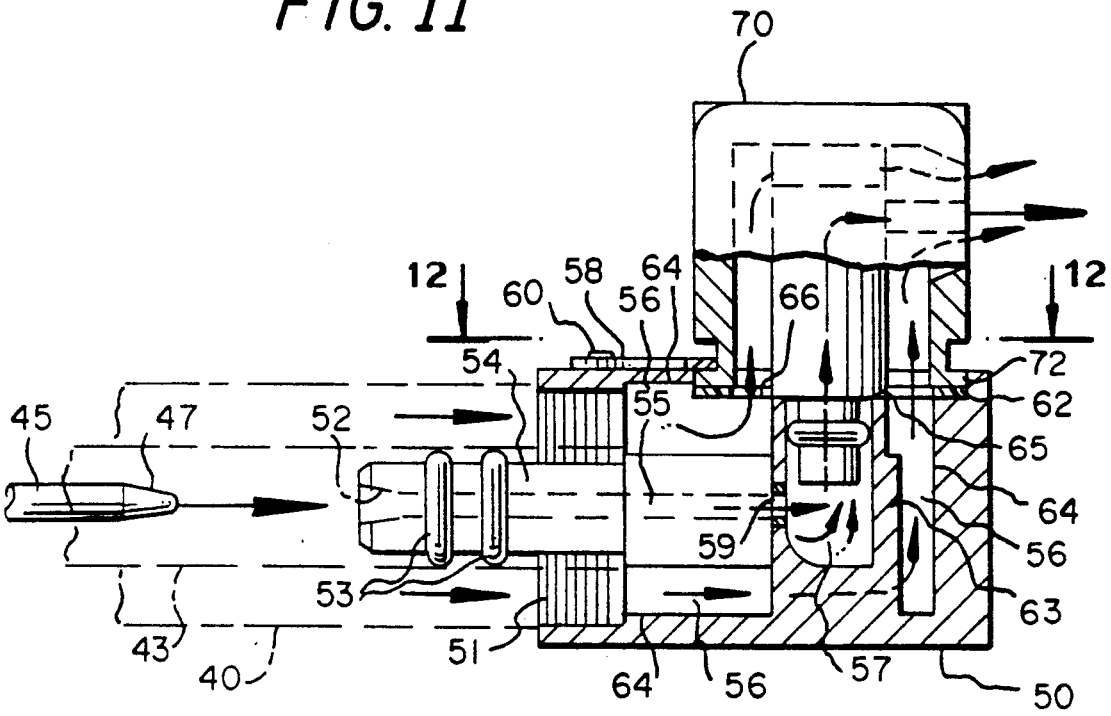
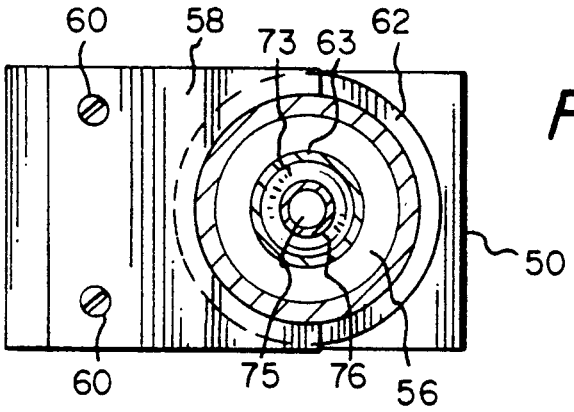
FIG. 12

SPRAY GUN EXTENSION

CROSS-REFERENCE TO RELATED APPLICATION

This application is a continuation-in-part of application Ser. No. 680,365, filed Apr. 4, 1991, now abandoned.

BACKGROUND OF THE INVENTION

1. Field of the Invention

This invention relates generally to the atomization of fluids and more particularly to the high volume, low pressure atomization and entrainment of liquids, such as paint, for application to a surface.

2. Description of Related Art

Devices which atomize and particulate fluids are widely used in the application of fluids such as paints and other coatings, cleaning solutions, solvents, blasting agents, solvents, sealants, lubricants and pesticides.

Two types of apparatus for the atomization and particulation of fluids are currently in use, namely pneumatic and airless. As they refer to application of paint type coatings, both types normally comprise high pressure apparatus. However, at least one type of low pressure system is also known and comprises the system disclosed in patents granted to the present inventor on Jul. 25, 1989, namely U.S. Pat. No. 4,850,809 entitled, "Air Operated Low Pressure Spraying System." and another patent on a low pressure system granted to the present inventor on Feb. 12, 1991, namely U.S. Pat. No. 4,991,776 entitled, "High Volume, Low Pressure Spraying System." U.S. Pat. Nos. 5,044,557 and 5,058,807 issued to the present inventor on Sep. 3, 1991 and Oct. 22, 1991, respectively, and are entitled "Air Operated Low Pressure Spraying Systems." These patents are specifically incorporated herein by reference.

Conventional high pressure, low volume pneumatic systems have the disadvantage of locally producing a wasteful cloud of fluid and air commonly referred to as "overspray". The solvent vapors become part of the atmosphere and present a hazard not only to the environment and user, but also to the atomizing equipment. The visible components of overspray comprise solids entrapped in the vapor or aerosol which results not only in the degrading of the quality of the work surface, but also in the contamination of the work site. High pressure, airless systems also generate a type of waste referred to as "bounceback". This condition is created by the high velocity by which the fluid is propelled to the surface. The rebounding particles, solids and vapors, form a cloud similar to the overspray generated by pneumatic apparatus. Both types of systems, however, produce the same undesirable and wasteful results.

Overspray and its reduction has become a subject of major concern to industries involved in the atomization of fluids. An amendment to the "Clean Air Act" of February, 1987 as it relates to hydrocarbon emission controls, established limitations and standards of performance for fluid transfer. Those industries affected are manufacturers and end users of commercial and consumer solvents, architectural coatings, pesticides, and all apparatus and methods involved in their application. Particular emphasis is being placed on government and military users. Additionally, individual states are implementing this act with their own pollution control bills. In some states, high pressure paint systems and adaptations that rely on high pressure, low volume application of atomization are being studied for restricted use. This could have a disastrous effect on thousands of small businesses. Manufacturers of fluids, in order to reduce the percentage of carrier solvents, are now required to increase their solids content and change fluid chemistry. This places new burdens on the atomizing system to atomize these high solids and viscosities.

All spraying systems require some type of apparatus to atomize the fluid and deliver it to the work surface. This apparatus is commonly called a spray gun. Guns vary in their configuration, size, weight and internal composition.

Extensions for liquid spraying devices are known. U.S. Pat. No. 1,961,481 disclosed a straight extension conventional paint spraying device with a movable nozzle which delivered a fixed pattern fluid flow of fixed pattern width. U.S. Pat. 3,700,174 disclosed an airless spray gun extension with a curved shank constructed to withstand high pressures of up to 2,500 psi or more.

There is a need for a detachable spraying assembly for a high volume low pressure system which will direct atomized liquid to a targeted position and will apply the liquid in a variety of directions, fluid flows, pattern widths, and fan shapes. Such an assembly should accommodate a diversity of applications, including spraying into areas difficult of access.

SUMMARY OF THE INVENTION

This invention provides an improvement to spray guns for atomizable liquids which use the high volume low pressure method. The improvement comprises an extension tube rotatively mounted on the spray gun with a spray assembly comprised of a mounting block and a mounted spray head. A variety of spray heads may be used, including a fixed spray head with a conventional fluid tip, an adjustable spray head, and a fixed spray head with a non-conventional fluid tip.

This invention may be used to spray areas which normally are not accessible using conventional spray guns. The small size of the extension spray assembly and the ability to adjust the direction of the spray means the gun may be used in areas accessible only through small holes. Such areas are common on ships and on helicopters, for example.

The use of high volume low pressure spraying means a coating may be applied in a well defined mil thickness, even in a difficult to spray area such as a right-angle butt joint. Spraying such a joint with a conventional high pressure or conventional airless spray apparatus results in the formation of a vortex in the right angle joint. The vortex results in uneven application of a coating, with some areas receiving minimal coverage and adjacent areas 10–20 times the required coverage. This results in inadequate drying in the thicker areas of coverage, which leads to cracking, crazing and failure of the coating. The present invention avoids this problem.

The present invention has a valve which controls the flow of fluid located near the outlet end of the extension tube at the spray assembly. Location of the valve at the spray assembly is important to this invention and has the advantage of making the length of the extension tube irrelevant to the control of the fluid flow. Tubes as long as 8 feet long have been fabricated. A conventional fixed fluid tip spray head which provides spray patterns either fan or circular in shape may be used. Alternatively, an adjustably spray head which is adjustable in pattern width and fan shape may be used. In addition, a fixed fluid tip spray head with a non-conventional fluid tip which has a non-circular cross-section may be used.

It is an object of the invention to provide an improvement in systems for atomizing fluids.

It is a further object of the invention to provide an improvement in high volume low pressure systems for spraying paints and other coatings, cleaning solutions, solvents, blasting agents, solvents, sealants, lubricants and pesticides.

It is a further object of the invention to provide an extension for a high volume low pressure spray gun which will allow spraying of equipment and enclosures presenting a myriad of angles and otherwise inaccessible spaces.

It is a further object of the invention to provide an extension for a high volume low pressure spray gun which will permit specified mil coverage in areas normally inaccessible to conventional spraying.

It is a further object of the invention to provide an extension for a high volume low pressure spray gun which will avoid overcoating of coatings and attendant cracking and crazing.

It is a further object of the invention to provide an extension for a high volume low pressure spray gun which will apply coatings without vortexing.

It is a further object of the invention to provide an extension for a high volume low pressure spray gun with a needle valve positioned in the extension near the point of application which a allows uniform and regulative flow rate of the fluid.

It is a further object of the invention to provide an extension for a high volume low pressure spray gun which will direct the atomized liquid in a 360° circle.

It is a further object of the invention to provide an spray head for a high volume low pressure spray gun which may be rotated to direct the atomized liquid in a 360° circle.

It is a further object of the invention to provide an extension for a high volume low pressure spray gun with a spray head having a nozzle and air cap which can be configured to a full range of fluid flows, pattern widths, and fan shapes.

It is a further object of the invention to provide an extension for a high volume low pressure spray gun with spray heads of different diameters which may accommodate a variety of areas difficult of access.

It is a further object of the invention to provide an extension for a high volume low pressure spray gun with an extension length which may be varied.

Further objects, features, and attributes of the present invention will become apparent from the following description and appended claims.

BRIEF DESCRIPTION OF THE DRAWINGS

FIG. 4 is a side elevation view in section of the proximal end of the extension tube.

FIG. 5 is a front elevation view of the embodiment 1 spray assembly spray head.

FIG. 6 is a bottom view of embodiment 1 spray assembly spray head.

FIG. 7 is a side elevation in section of embodiment 1 spray assembly spray head taken along line 7—7 of FIG. 6.

FIG. 11 is a side elevation view partially in section of the embodiment 1 spray assembly showing the needle valve.

FIG. 12 is a top view of the embodiment 1 spray assembly mounting block with the assembly plate in place.

DESCRIPTION OF PREFERRED EMBODIMENTS

Figure 1:
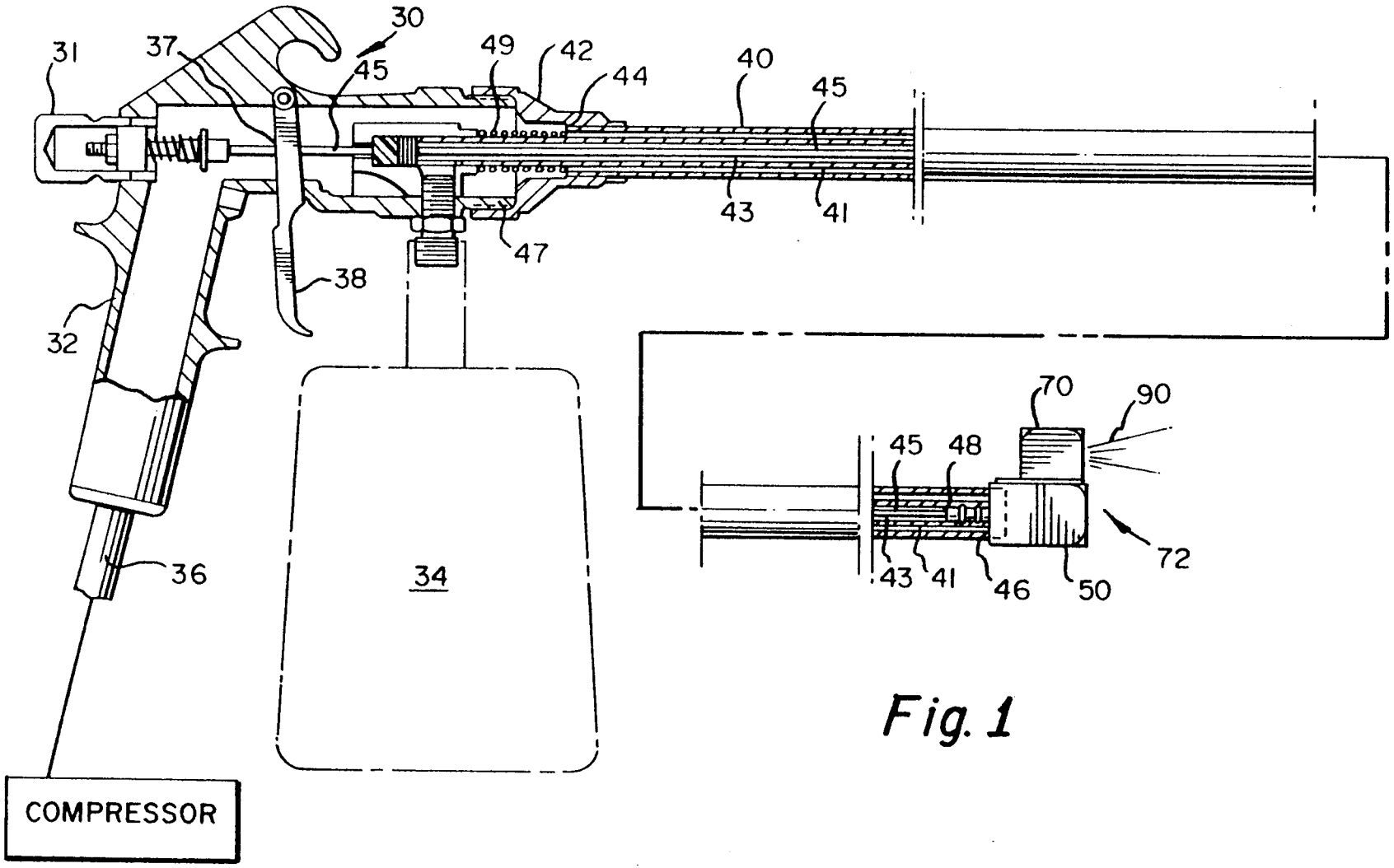
FIG. 1 is a side elevation view partially in section of the spray extension with an embodiment 1 spray assembly.

FIG. 1 is a side elevation view partially in section of a conventional high volume low pressure spray gun equipped with an extension of the present invention. A conventional spray gun 30 is shown with a handle 32 liquid container 34, low pressure air hose 36, trigger 38, and fluid flow control knob 31.

The extension assembly comprises a collar 42, extension tube 40, mounting block 50, and spray head 70. The mounting block and spray head together comprise embodiment 1 spray assembly 72. The collar 42 is connected by a threaded joint 47 to the spray gun. The extension tube 40 has a flared inlet end 44 and an outlet end 46. The flared inlet end of the extension tube is retained by a shoulder on the collar 39 in FIG. 4. A spring 49 biases the flared end of the extension tube 44 against the collar 42. The extension tube may be rotated through a 360° circle while retained by the collar.

A mounting block 50 is mounted at its side to the outlet end of the extension tube 46 by a threaded joint. A spray head 70 is rotatively mounted on top of the mounting block. The spray head may be rotated through a 360° circle. In FIG. 1 spray 90 is depicted emitted from the spray head in a direction away from the spray gun.

A passage for low pressure air runs the length of the extension tube. The low pressure air passage 41 is formed of the space between the interior of the extension tube 40 and the exterior of a liquid tube 43. Low pressure air from the spray gun transverses the extension tube through the low pressure air passage, transverses the mounting block 50, and is emitted from the spray head 70.

A passage for liquid or liquid tube 43 is mounted within and concentric with the low pressure air passage 41. The liquid tube is in fluid flow communication with the liquid container. Liquid from the liquid container 34 transverses the extension tube through the liquid tube 43, passes through the mounting block 50, and is emitted through the spray head 70.

A needle extension 45 extends from the fluid flow control knob 31 through the body of the spray gun and transverses the extension tube. The needle extension is mounted within and concentric with the liquid tube 43.

The needle extension terminates in a needle valve 48 also shown in FIG. 11 formed of a needle point 47, and a nozzle 52, connected to the mounting block 50. The needle extension is connected to the trigger at a trigger link 37 in FIG. 1 so that pulling the trigger displaces the needle extension and the needle point backwards toward the spray gun. Movement of the needle point toward the spray gun opens the needle valve and allows liquid to flow from the reservoir through the extension tube into the spray assembly. Movement of the needle point toward the outlet end of the extension tube closes the needle valve. The extent of movement of the needle extension is controlled by the fluid flow control valve 31.

Figure 2:
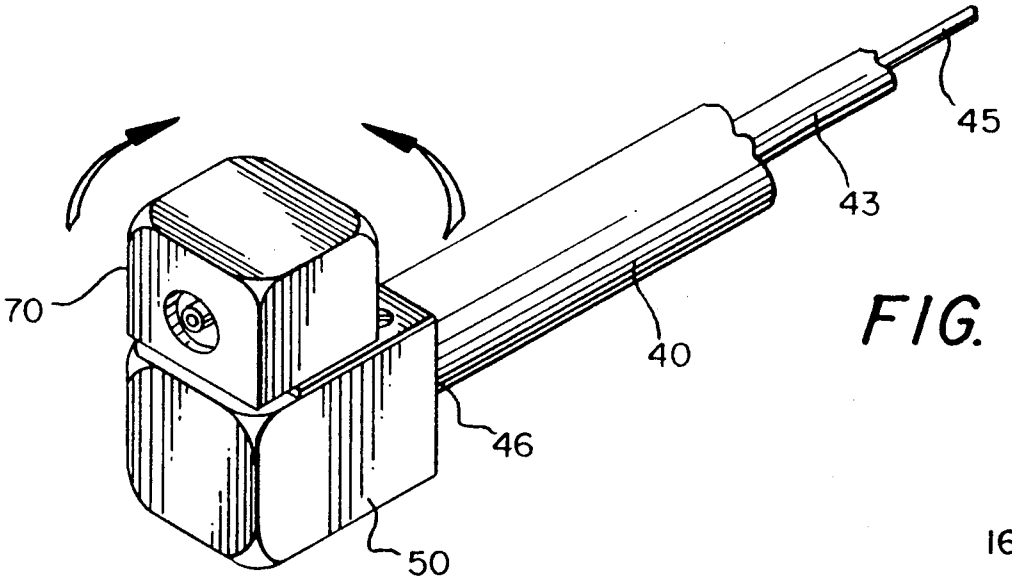
FIG. 2 is a perspective view of a portion of the extension tube with the embodiment 1 spray assembly of FIG. 1.

FIG. 2 is a perspective view showing the relative positions of the outlet end of the extension tube 46, mounting block 50, and the spray head 70. Rotative movement of the spray head is depicted by arrows. The embodiment 1 spray assembly comprises the mounting block and spray head of FIGS. 2, 11.

Figure 8:
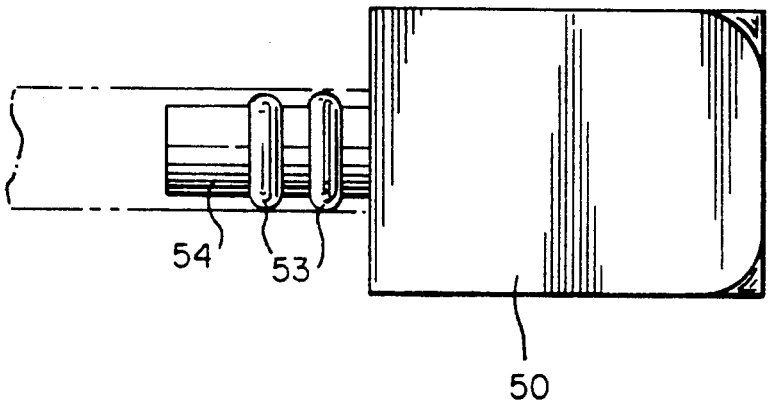
FIG. 8 is a side elevation view of embodiment 1 spray assembly mounting block.

FIG. 8 is a side view of the mounting block 50 of the first embodiment spray assembly. The block liquid tube 54 extends from the rear of the block. 0-rings 53 seal the connection between the block liquid tube and the lumen of the liquid tube of the extension tube.

FIG. 11 shows the internal structure of the mounting block 50 and the relation between mounting block and extension tube as well as the relation between mounting block and spray head. FIG. 12 shows the top view of the mounting block. The mounting block 50 is fixed to the outlet end of the extension tube by a threaded joint 51. A block liquid tube 54 extends from the mounting block into the lumen of the liquid tube 43 of the extension tube. Two o-rings 53 seal the junction of block liquid tube and extension tube liquid tube. The lumen of the block liquid tube 55 is expanded to form a tapered nozzle 52 which interacts with the needle 47 to form a needle valve which controls passage of liquid from the liquid tube 43 into the block liquid tube 54. A cylindrical cavity called a liquid reservoir 57 is surrounded by a liquid reservoir wall 63 and is located adjacent to the outlet end of the block liquid tube. The long axis of the liquid reservoir wall 63 is oriented perpendicular to the axis of the liquid tube. Liquid flowing through the lumen of the block liquid tube 55 enters the liquid reservoir 57 through a hole 59 in the liquid reservoir wall 63. Liquid enters the block from the outlet end of the extension tube through the nozzle of the block liquid tube and then flows through the hole into the liquid reservoir. Liquid leaves the block through the open upper end of the liquid reservoir 65.

A block low pressure air passage 56 is formed between the block liquid tube 54 and the interior wall of the block 64. The block low pressure air passage extends to the area between the liquid reservoir wall 63 and the interior wall of the block. Low pressure air leaves the block through the circular open end of the block low pressure air passage 66 located on the top of the block. The liquid reservoir 57 is concentric with the block low pressure air passage 56. The block low pressure air passage communicates with the low pressure air passage 41 of the extension tube. Low pressure air from the outlet of the extension tube passes through the block low pressure air passage into the spray head.

A recess 62 is cut into the top of the mounting block surrounding the open end of the block low pressure air passage 66. A spray head 70 is mounted at the inlet end 72 in the recess. A locking notch 74 is cut around the inlet end of the spray head. A locking plate 58 secured by screws 60 attaches the spray head to the mounting block so that the spray head is secured in place yet may be rotated in a 360° circle. Removal of the locking plate allows demounting of the spray head for periodic maintenance and for replacement of the spray head o-ring as required.

Figure 9:
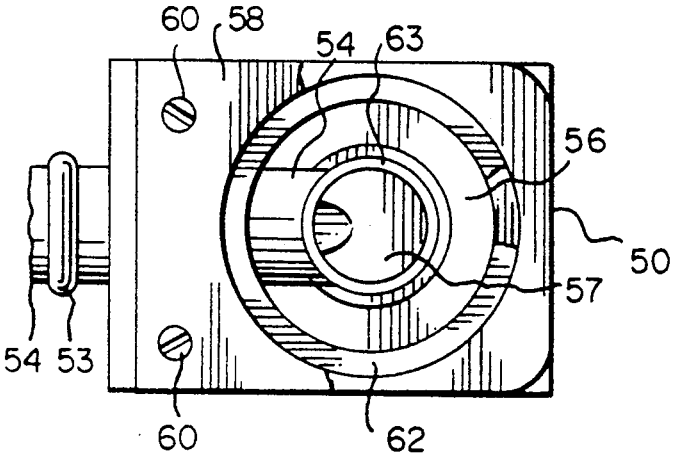
FIG. 9 is a top view of embodiment 1 spray assembly mounting block.

FIG. 9 is a top view of the embodiment 1 mounting block 50 showing the relationships between the recess 62, locking plate 58, screws 60, block liquid tube 54, o-rings 53, low pressure air passage 56, liquid reservoir wall 63, and liquid reservoir 57.

The embodiment 1 spray assembly spray head 70 is shown in a plane front view in FIG. 5, in bottom view in FIG. 6, and in section along the line 7—7 of FIG. 6 in FIG. 7. A head liquid tube 76 extends from the bottom section 72 of the spray head 70. The head liquid tube 76 is fitted into the open end 65 of the liquid reservoir 57 of the mounting block, as shown in FIG. 11. An o-ring 73 seals the head liquid tube in the liquid reservoir. The lumen 75 of the head liquid tube extends into the spray head and is intersected by the tip passage 77 bored perpendicularly to the head liquid tube lumen. A spray tip 78 is mounted into the tip passage by a threaded joint. Fluid passes from the mounting block fluid reservoir through the liquid tube into the tip passage and is emitted from the circular spray tip lumen 82.

A head low pressure air passage 80 is formed between the head liquid tube 76 and the inner wall 86 of the spray head. The head low pressure air passage surrounds the head liquid tube. A air outlet 84 in the spray head extends from the low pressure air passage to the outside of the spray head and is concentric with and surrounds the spray tip 78. The bore of the air outlet 84 is tapered with the larger diameter on the low pressure air passage side and the smaller diameter on the outside of the spray head. Low pressure air flows from the low pressure air passage of the mounting block through the head low pressure air passage and out of the spray head through the air outlet.

FIG. 6 is a bottom view of the embodiment 1 spray assembly spray head 70 showing the relationship between the low pressure air passage 80, o-ring 73, head liquid tube 76, head liquid tube lumen 75, tip passage 77, spray tip 78, and air outlet 84.

FIG. 12 is a top view of the embodiment 1 spray assembly mounting block 50 showing the relationships between the recess 62, locking plate 58, screws 60, low pressure air passage 56, liquid reservoir wall 63, liquid reservoir 57, o-ring of the spray head 73, head liquid tube 76, and lumen 75 of the head liquid tube.

Figure 10:
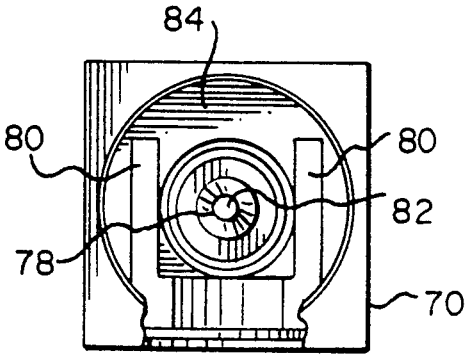
FIG. 10 is a front view in partial section of embodiment 1 spray assembly spray head.

FIG. 10 is a front view of embodiment 1 spray assembly spray head 70 in partial section showing the relationships between the air outlet 84, low pressure air passage 80, spray tip 78, and spray tip lumen 82.

In operation, fluid and low pressure air enter the extension tube at the inlet end, transverse the tube through their relative passages, and enter the mounting block. The fluid and low pressure air then leave the mounting block and enter the spray head where they are emitted onto the surface being sprayed. The interaction of low pressure air and fluid after emission from the spray head is important to the formation of the fan of sprayed fluid. In this embodiment, the low pressure air atomizes the liquid emitted from the spray tip. The low pressure air also encapsulates and surrounds the atomized stream and controls its delivery to the substrate. In this embodiment, the spray fan is circular.

Figure 3:
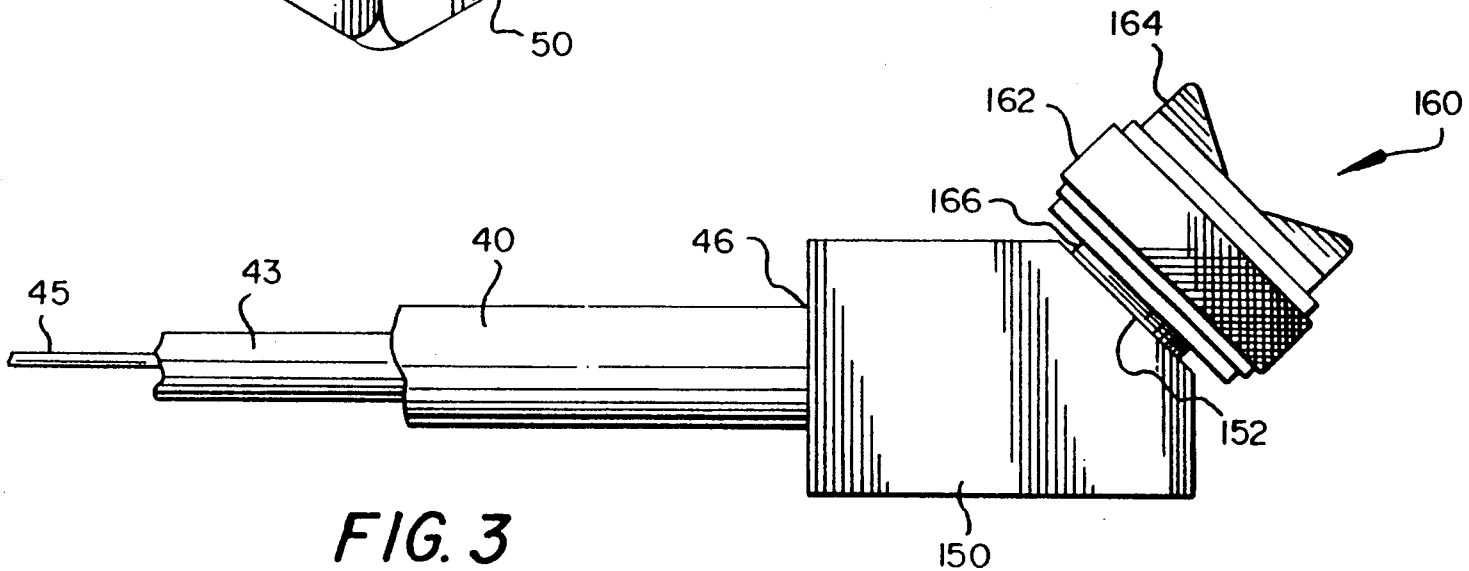
FIG. 3 is a side elevation view of the extension tube with embodiment 2 spray assembly.

FIG. 3 shows embodiment 2 spray assembly mounted on the outlet end 46 of the entension tube 40. The spray assembly comprises a mounting block 150 with a spray tip 160 fixedly attached to the mounting block by a threaded section 166. The mounting surface 152 is at an angle of 45° to both the top and the front of the mounting block. Any desired angle may be used to mount the spray tip on the mounting block. The fluid passages inside the mounting block are as in the mounting block of embodiment 1 spray assembly except the liquid reservoir and low pressure air passage are oriented away from the extension tube at an angle of 45°. The spray tip 160 is a conventional adjustable spray tip for high volume low pressure sprayers described in U.S. Pat. No. 3,796,376 incorporated herein by reference. The fan may be adjusted by manipulating the adjusting ring 162. This moves the air horn 164 toward or away from the mounting block, thus adjusting the pattern width and the fan shape of the fluid spray.

The embodiment 2 spray assembly may be used where access allows passage of a larger diameter assembly than embodiment 1. The embodiment 2 spray assembly is particularily useful in spraying areas which are accessible but not viewable, such as the tops of door frames.

Figure 13:
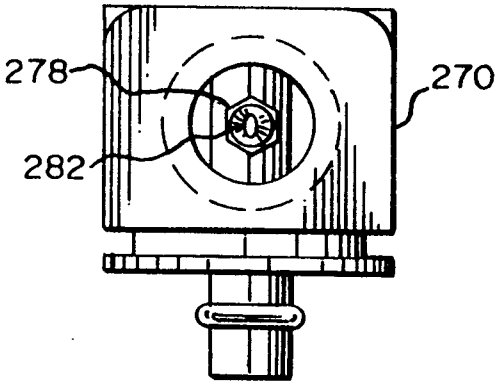
FIG. 13 is a front view of the embodiment 3 spray assembly spray head.

The embodiment 3 spray assembly differs from the embodiment 1 spray assembly only in the structure of the spray tip. The spray head 270 of the embodiment 3 spray assembly is shown in FIG. 13. The lumen 282 of the spray tip 278 is not circular but is oval. The oval shape lumen produces an oval shaped fan of liquid spray. The embodiment 3 spray assembly sprays a wider fan than does the embodiment 1 spray assembly.

Figure 14:
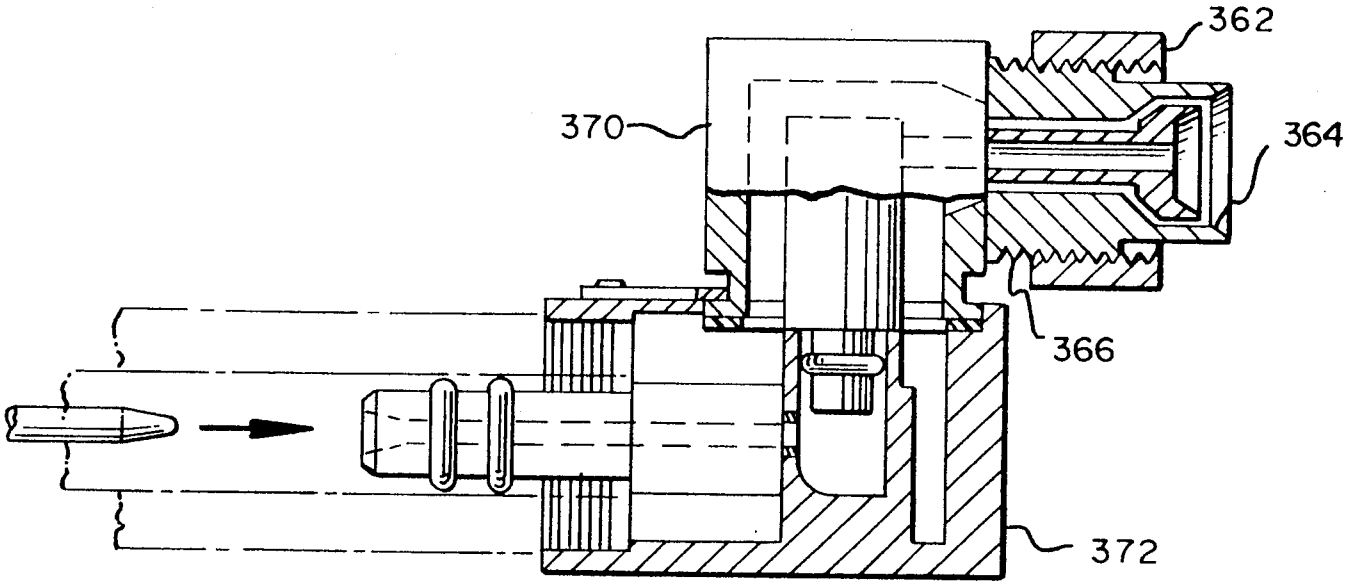
FIG. 14 is a side elevation view partially in section of the embodiment 4 spray assembly showing the needle valve.

The embodiment 4 spray assembly in FIG. 14 differs from the embodiment 1 spray assembly in the structure of the spray head. A threaded section 366 on the front of the spray head 370 is used to attach an adjustable spray tip as in embodiment 2 to the front of the rotatable spray head. The spray tip 360 is a conventional adjustable spray tip for high volume low pressure sprayers described in U.S. Pat. No. 3,796,376. Rotation of the adjusting ring 362 causes movement of the air horn 364 toward or away from the tip and thereby adjusts the pattern width and fan shape of the fluid spray. The spray head of embodiment 4 spray assembly may be adjusted to provide a variety of spray fan widths and patters and may also be rotated in a 360° circle.

It will be apparent to those skilled in the art that the examples and embodiments described herein are by way of illustration and not of limitation, and that other examples may be utilized without departing from the spirit and scope of the present invention, as set forth in the appended claims.

I claim:

1. An apparatus for spraying an atomizable liquid comprising:
- an air compressor,
- a spray gun having a container for said liquid,
- means for providing said spray gun with air from said compressor,
- an extension tube rotatively mounted on the spray gun,
- the extension tube having a spray assembly mounted thereon, and
- a valve located adjacent the spray assembly which controls the flow of fluid into the spray assembly,
- said spray assembly comprising an assembly block and an attached spray head,
- the assembly block having a passage for liquid concentric with a passage for air,
- said passage for liquid comprising a block liquid tube and a liquid reservoir oriented about perpendicular to the block liquid tube,
- the spray head having a head liquid tube extending into the reservoir and concentric with a passage for air and a spray tip mounted about perpendicular to the head liquid tube and concentric with an air outlet,
- the spray tip having a lumen for passage of liquid,
- the spray head mounted on the assembly block with the liquid and air passages of the spray head aligned with those of the assembly block, in order to provide an unobstructed flow of liquid and of air through the assembly block and through the spray head, the liquid emerging from the spray tip lumen concentric with air from the compressor, and
- the spray head removably attached to the mounting block by a locking notch and a locking plate, allowing rotation of the spray head in a 360° circle.

2. The apparatus of claim 1 wherein the spray tip lumen is circular.

3. The apparatus of claim 1 wherein the spray tip lumen is oval.

* * * * *